US006279274B1

(12) United States Patent
Amiet et al.

(10) Patent No.: US 6,279,274 B1
(45) Date of Patent: Aug. 28, 2001

(54) CAST-IN FITTINGS FOR CONCRETE COMPONENTS

(75) Inventors: Shoal David Amiet, Box Hill; Ian Ross Ferrier, Wantirna South, both of (AU)

(73) Assignee: Ramset Fasteners (Aust.) Pty. Ltd., Victoria (AU)

( * ) Notice: Subject to any disclaimer, the term of this patent is extended or adjusted under 35 U.S.C. 154(b) by 0 days.

(21) Appl. No.: 09/397,593

(22) Filed: Sep. 16, 1999

(30) Foreign Application Priority Data

Sep. 16, 1998 (AU) ..... PP 99 5925

(51) Int. Cl.[7] ..... E02D 5/72

(52) U.S. Cl. ..... 52/125.2; 52/125.4; 52/125.6; 52/677; 52/688; 52/689

(58) Field of Search ..... 52/125.2, 125.4, 52/125.5, 125.6, 125.1, 677, 686, 688, 689

(56) References Cited

U.S. PATENT DOCUMENTS

| | | | | |
|---|---|---|---|---|
| 2,772,560 | * | 12/1956 | Neptune | 52/125.4 X |
| 2,930,220 | * | 3/1960 | Hamilton et al. | 52/125.1 |
| 3,195,278 | * | 7/1965 | Ballou | 52/125.5 X |
| 3,199,259 | * | 8/1965 | Long | 52/125.1 X |
| 3,350,820 | * | 11/1967 | Stonely | 52/125.2 X |
| 3,420,014 | * | 1/1969 | Courtois et al. | 52/125.4 |
| 3,431,012 | * | 3/1969 | Courtois et al. | 52/125.4 X |
| 3,705,469 | * | 12/1972 | Eriksson | 52/125.4 |
| 4,179,151 | * | 12/1979 | Tye | 294/125.5 X |
| 4,437,642 | * | 3/1984 | Holt | 249/175 |
| 4,580,378 | * | 4/1986 | Kelly et al. | 52/125.5 |
| 4,947,613 | * | 8/1990 | Fricker | 52/125.4 X |
| 5,014,473 | * | 5/1991 | Kelly et al. | 52/125.5 |
| 5,242,249 | * | 9/1993 | Grayson | 405/286 |
| 5,588,263 | * | 12/1996 | Kelly et al. | 52/125.4 |

FOREIGN PATENT DOCUMENTS

953942 * 9/1974 (CA) ..... 52/125.5

OTHER PUBLICATIONS

Product Bulletin: "Concrete Lifting Systems" 125mm Face Lift Anchor—FL50125; Ramset Fastening Systems.

* cited by examiner

*Primary Examiner*—Carl D. Friedman
*Assistant Examiner*—Phi Dieu Tran A
(74) *Attorney, Agent, or Firm*—Harness, Dickey & Pierce

(57) ABSTRACT

A shoe for use with a fitting such as a lifting anchor or ferrule adapted to be cast into a reinforced concrete component, the shoe serving, in use, to locate tie-in bars relative to the fitting. The shoe comprises a body portion slidably received on a shank of the fitting, and clips for engaging with a snap-in action tie-in bars extending at opposite sides of the shank. The shoe can be retro-fitted to a pre-existing anchor assembly comprising an anchor, support, and void former.

7 Claims, 2 Drawing Sheets

CAST-IN FITTINGS FOR CONCRETE COMPONENTS

BACKGROUND OF THE INVENTION

1. Field of the Invention

The present invention relates to fittings adapted to be incorporated into concrete components during casting thereof.

2. Description of the Prior Art

In the fabrication of certain reinforced concrete components for use in building construction it may sometimes be necessary to incorporate within the structure of the concrete component during casting, a fitting such as an internally-threaded ferrule for forming a subsequent fixing point within the component or a lifting anchor which forms a lifting point for attachment of components of a lifting system used in the erection of the component. In one form, the ferrule or anchor is carried by a support chair which rests on the base of formwork for the concrete component, with the ferrule or anchor extending upwardly from the chair. The assembly consisting of the support chair with the ferrule or anchor is tied into the reinforcement using short lengths of reinforcing bar. When the concrete is subsequently poured into the formwork the assembly of the support chair and ferrule or anchor is incorporated within the structure of the concrete component and is firmly retained due to the tie bars which link the assembly to the main reinforcement of the component. The applicants have now determined that a difficulty can arise in that interaction between the tie bars and the shank of the ferrule or anchor sometimes can cause the tie bars to lift the assembly off from the base of the formwork if, as not infrequently happens, an operator happens to step on the reinforcement prior to casting. This in turn may mean that the head of the ferrule or anchor is no longer at the correct distance from the face of the component formed by the base of the formwork and also the assembly consisting of the support chair and ferrule or anchor may tilt relative to the lower face of the formwork.

SUMMARY OF THE INVENTION

According to the present invention, there is provided a shoe for use with a fitting such as a lifting anchor or ferrule adapted to be cast into a reinforced concrete component, said shoe serving, in use, to locate tie-in bars relative to the fitting and comprising a body portion adapted to be slidably received on a shank of the fitting, and means for engaging tie-in bars extending at opposite sides of the shank.

In a preferred embodiment of the invention the engaging means comprises one or more clips for engagement with the tie-in bars.

Advantageously, the clips are arranged to couple with the tie bars with a snap-in engagement.

The present invention also provides an assembly consisting of a support for resting on the base of formwork for said component, a said fitting carried by the support so as to be upstanding therefrom, and a said shoe slidably mounted on the shank of the said fitting for engagement with tie-in bars of the reinforcement.

Advantageously, the fitting carries at its lower end a transverse shear pin and the shoe is mounted on the shank above the shear pin.

When the said fitting is a lifting anchor, the assembly preferably also consists of a void former mounted on the head of the anchor, with the shoe being movable along the shank of the anchor between the void former and support.

The invention also provides a said shoe for retro-fitting onto a lifting anchor assembly comprising the support, the anchor, and a void former attached to the head of the anchor, said shoe being in the form of two or more parts which can be assembled around the shank of the anchor or said shoe being of one-piece split construction which enables the shoe to be fitted onto the shank by opening the shoe to permit passage over the shank.

BRIEF DESCRIPTION OF THE DRAWINGS

An embodiment of the invention will now be described, by way of example, with reference to the accompanying drawings in which.

DESCRIPTION OF THE PREFERRED EMBODIMENT

Figure 1:
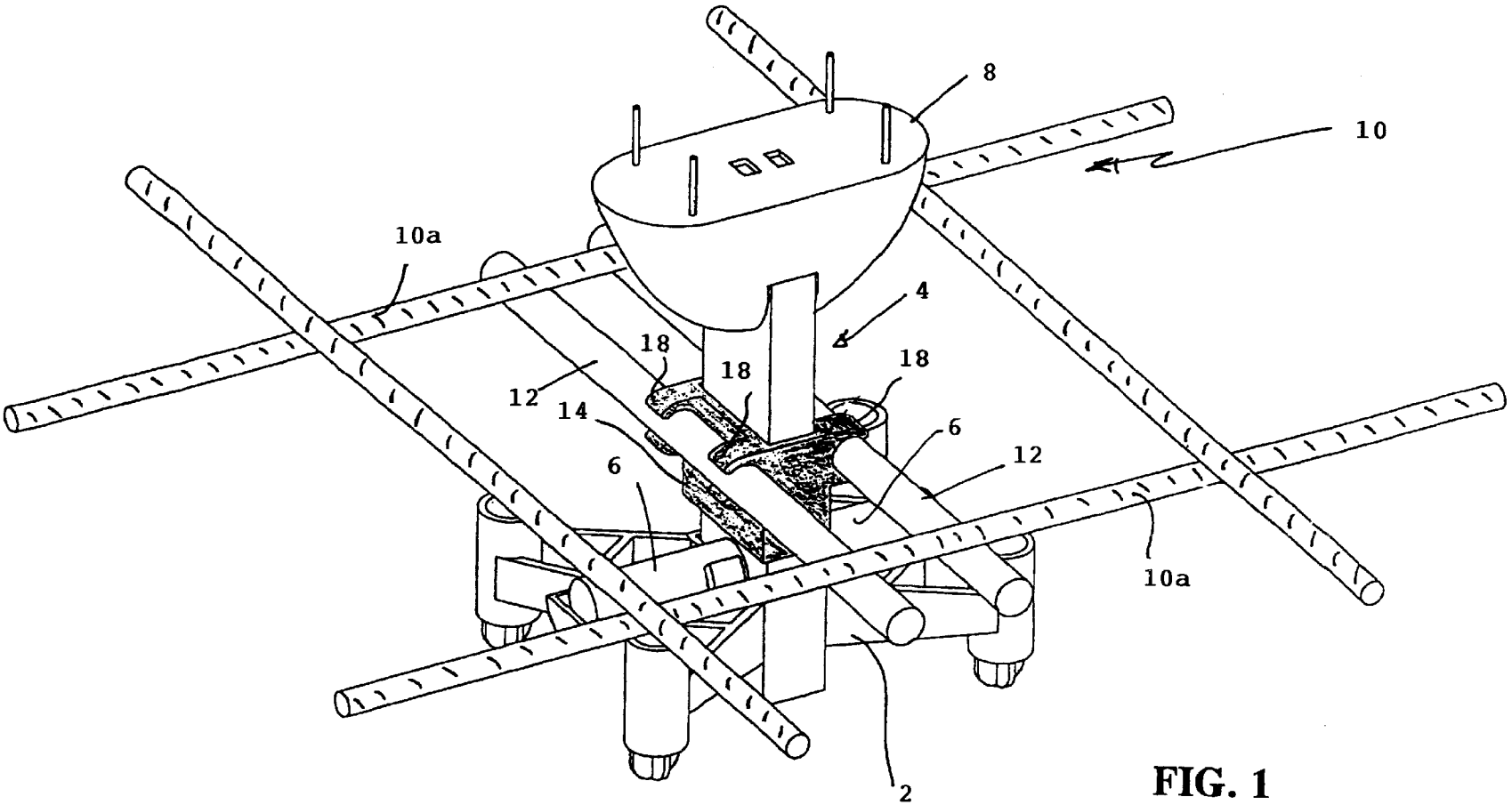
FIG. 1 is a perspective view showing a lifting anchor assembly tied into reinforcement of a concrete component being cast, using a locating shoe in accordance with a preferred embodiment of the invention.

As shown in FIG. 1 of the accompanying drawings an anchor assembly for use in so-called face-lifting of a concrete component comprises a support chair or stand 2 which rests on the base of formwork and a lifting anchor 4 carried by the support chair 2. At its lower end the anchor 4 is apertured to receive a transverse shear pin 6 which extends to both sides of the anchor 4. The shear pin 6 is located within the support chair 2 and after casting of the component forms a primary element of the securement of the anchor 4 within the component. At its upper end the anchor carries a void former 8 which remains in situ during casting. The void former 8 is removed after casting to form within the upper surface of the cast component a recess for receipt of a part of the concrete lifting system, such as a lifting clutch, which co-operates with a lifting eye at the upper end of the anchor. Thus far the anchor assembly as described is substantially conventional. The anchor assembly is tied into the mesh reinforcement 10 of the component by tie bars 12 which pass either side of the shank of the anchor 4 transversely to the axis of the shear pin 6, the opposite ends of the tie bars 12 being connected to the adjacent reinforcing bars 10*a* by wire ties (not shown).

Figure 2:
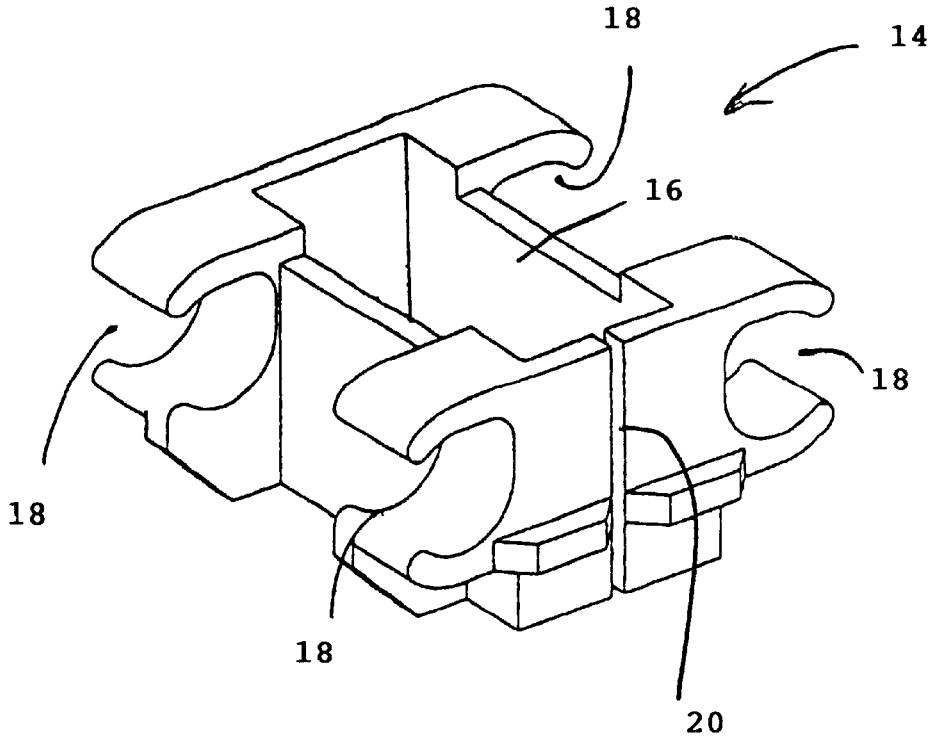
FIG. 2 is a perspective view of the locating shoe.

In accordance with the invention, the tie bars 12 are correctly located relative to the shank of the anchor 4 by a shoe 14 which is slidably mounted on the shank of the anchor 4 so that vertical displacement of the tie bars 12, as may occur when an operator steps on the reinforcement, will cause the tie bars 12 coupled to the shoe 14 to slide along the shank of the anchor 4 without actually displacing the anchor 4. More particularly, as shown in detail in FIG. 2, the shoe 14 is of tubular form with an internal passage 16 of a cross-section corresponding to the cross-section of the anchor shank and sized so as to be a sliding fit on the anchor shank. At each side, the shoe 14 comprises one or more zones 18 of attachment by which the shoe 14 is attached to the adjacent tie rod 12. Advantageously these zones 18 of attachment are formed by part-cylindrical clips which engage with the tie rods 12 as a snap fit. In the form shown there are two such clips 18 at each side of the shoe 14 although it is to be understood that other arrangements are possible; for example at each side there may be only one such clip but with that clip being of a length in the axial direction of the tie rod to ensure sufficient stability of the attachment between the shoe and the tie rod. Attachment of the tie rods 12 to the shoe 14 could also be by means of attachment of a different form to that of the snap action clips shown. Part circular recesses may be formed in the lower edge of the shoe 14 to engage over the shear pin 6 when the shoe 14 is located immediately adjacent the support chair 2. A shoe in the form described can be fabricated as a relatively simple plastics moulding.

The use of the sliding shoe 14 just described to locate the tie rods 12 relative to the shank of the anchor not only permits upwards and downwards movement of the tie rods 12 to take place without affecting the vertical position of the anchor 4, but also ensures that if the anchor itself is subject to disturbance, for example if someone actually treads on the anchor, the anchor will be restrained against tilting either transversely to the direction of the tie bars 12 or in the direction of the tie bars 12 due to the constraint imposed by the co-operation between the shoe 14 and the tie bars 12. The sliding movement of the shoe 14 on the shank of the anchor 4 also means that when the anchor assembly is being installed within the reinforcement 10, the position of the shoe 14 along the shank of the anchor 4 will automatically self-adjust to suit the height of the reinforcement which has been set up. It also enables a single design of shoe to be used irrespective of the length of the anchor and hence irrespective of the depth of the component being fabricated.

In one form, the anchor assembly is supplied to the customer in assembled form consisting of the support chair 2 to which the anchor 4 is attached via shear pin 6, a void former 8 mounted on the head of the anchor 4, and a shoe 14 located on the shank of the anchor between the support chair 2 and the void former 8, the shoe 14 being mounted on the anchor prior to attachment of the void former. However the shoe 14 can also be fabricated in a form which enables it to be retro-fitted to an anchor assembly consisting of support chair, shear pin, anchor and void former prior to installation of the anchor assembly. For example the shoe 14 can consist of two mating parts which can be clipped together around the shank of the anchor by application of the two parts laterally onto the shank. Alternatively and as illustrated, the shoe 14 may be of an open one-piece construction, for example a C-shaped construction with a break 20 in one of its side walls or end walls which can be opened sufficiently to enable the shoe to be pushed laterally onto the shank of the anchor with the gap then closing under the inherent resilience of the plastics material from which the shoe is fabricated. In another alternative, a shoe 14 of one-piece open construction can comprise two parts interconnected by an integral hinge which enables the two parts to be swung open to permit passage over the shank of the anchor, and after application to the shank, the two parts are closed together and then locked by mating of integral clip components carried by the two parts.

Although the shoe in the illustrated embodiment is designed for use with a lifting anchor, it is to be understood that a shoe constructed in accordance with the principles described could also be used with other cast-in fittings such as internally-threaded ferrules and in this latter case the internal passage of the shoe would be of a cylindrical shape to match the cross-sectional shape of the ferrule.

The embodiments have been described by way of example only and modifications are possible within the scope of the invention.

What is claimed is:

1. An assembly consisting of a support for resting on the base of formwork for a reinforced concrete component including reinforcement, a fitting carried by the support so as to be upstanding therefrom, said fitting having a shank and being adapted to be cast into said reinforced concrete component, and a shoe for locating tie-in bars of the reinforcement relative to said fitting, said shoe comprising a body portion slidably mounted on said shank of said fitting, and said shoe comprising respective clips at opposite sides of the body portion for engagement with the tie-in bars of the reinforcement, wherein said fitting carries at its lower end a transverse shear pin and said shoe is mounted on said shank above said shear pin.

2. An assembly according to claim 1, wherein said fitting is a lifting anchor, the assembly further consisting of a void mounted on the head of said anchor and said shoe being movable along said shank of said anchor between said void former and said support, wherein said body portion of said shoe is of split construction which enables said body portion to be applied to said shank of said anchor by lateral movement relative to said shank.

3. A cast-in anchor assembly for a reinforced concrete component, said anchor assembly comprising:

a support, said support resting on a base of a formwork for said reinforced concrete component;

an anchor comprising a shank, said anchor being carried by said support so as to be generally vertically upstanding therefrom and adapted to be cast into said reinforced concrete component;

at least one tie-in bar extending in a direction transverse to said shank of said anchor; and a shoe locating said at least one tie-in bar relative to said anchor, said shoe being slidably mounted on said shank of said anchor to permit upward and downward movement of said shoe relative to said shank and to said support, said shoe comprising:

a body portion including first and second opposite sides: and a plurality of mounting clips, at least one said mounting clip located on each of said first and second opposite sides of said body portion, at least one said mounting clip attaching said at least one tie-in bar to said shoe whereby said shoe moves upwardly and downwardly in response to upward and downward movement of said at least one tie-in bar.

4. An assembly according to claim 3, wherein said anchor carries at its lower end a transverse shear pin and the shoe is mounted on the shank above the shear pin.

5. An assembly according to claim 4, wherein said anchor is a lifting anchor, said assembly further consisting of a void former mounted on the head of the anchor, and the shoe being movable along the shank of the anchor between the void former and support.

6. The anchor assembly of claim 3, wherein said mounting clips are generally cylindrical and attach to said at least one tie-in bar with a snap fit.

7. An assembly according to claim 3, wherein said anchor is a lifting anchor, the assembly further consisting of a void former mounted on the head of said anchor and said shoe being movable along said shank of said anchor between said void former and said support, wherein said body portion of said shoe is of split construction which enables said body portion to be applied to said shank of said anchor by lateral movement relative to said shank.

* * * * *

UNITED STATES PATENT AND TRADEMARK OFFICE

CERTIFICATE OF CORRECTION

PATENT NO. : 6,279,274 B1
DATED : August 28, 2001
INVENTOR(S) : Shoal David Amiet et al.

It is certified that error appears in the above-identified patent and that said Letters Patent is hereby corrected as shown below:

Title page,
Item [30], Foreign Application Priority Data, kindly delete "PP 99 5925" and insert therefor -- PP 5925/98 --.

Signed and Sealed this

Twenty-third Day of July, 2002

*Attest:*

*Attesting Officer*

JAMES E. ROGAN
*Director of the United States Patent and Trademark Office*